United States Patent [19]

Hines

[11] Patent Number: 4,608,620

[45] Date of Patent: Aug. 26, 1986

[54] MAGNETIC SENSOR FOR ARMATURE AND STATOR

[75] Inventor: George Hines, Pittsburgh, Pa.

[73] Assignee: Westinghouse Electric Corp., Pittsburgh, Pa.

[21] Appl. No.: 798,257

[22] Filed: Nov. 14, 1985

[51] Int. Cl.[4] ..... H01H 47/22

[52] U.S. Cl. ..... 361/154; 361/170

[58] Field of Search ..... 361/154, 170

[56] References Cited

U.S. PATENT DOCUMENTS 3,330,994 7/1967 Kussy ..... 361/154

3,671,814 6/1972 Dick ..... 361/170 X 3,974,425 8/1976 Ueda et al. ..... 361/170

*Primary Examiner*—Michael L. Gellner

*Attorney, Agent, or Firm*—L. P. Johns

[57] ABSTRACT

A magnetic sensing device for controlling power required for maintaining an armature in a closed position on a stator, characterized by a soft-iron shunt extending between and spaced from the armature and stator for conducting a magnetic field therebetween and a magnetic field sensor between the stator and the shunt for monitoring the magnetic field and for controlling power to a coil of the stator.

5 Claims, 2 Drawing Figures

MAGNETIC SENSOR FOR ARMATURE AND STATOR

BACKGROUND OF THE INVENTION

1. Field of the Invention

This invention relates to an electromagnetically operated device having a sensor for monitoring the magnetic field for controlling power admitted to the coil of the device.

2. Description of the Prior Art

Electromagnetically operated devices such as large relays and contactors consume much more power to close an armature than is required to maintain the armature closure. As a result excess power is consumed which is indicated by vibration between the armature and stator as well as heating of the pull-in coil. It has been recognized that when an armature is closed on a stator, the power required to maintain the device in the closed position could be reduced to conserve power, reduce vibration, and reduce heating of the coil.

SUMMARY OF THE INVENTION

A magnetic sensing device for controlling power for maintaining the closed condition of an electromagnetic device is provided which comprises a stator having an energizing coil for inducing a magnetic field; an armature movable between open and closed positions of the stator and forming a gap between the armature and stator when in the open position; a soft iron shunt spaced from the armature and stator and extending adjacent thereto for transferring the magnetic field therebetween; a magnetic sensing device between the shunt and the stator for monitoring the magnetic field and for producing a resulting voltage; and control means responsive to the voltage produced by the device for controlling the power applied to the coil so as to reduce power to the coil in response to a reduced magnetic field when the gap is closed.

The advantage of the device of this invention is that it conserves power, reduces vibrations, and reduces heating of the pull-in coil.

DESCRIPTION OF THE PREFERRED EMBODIMENT

Figure 1:
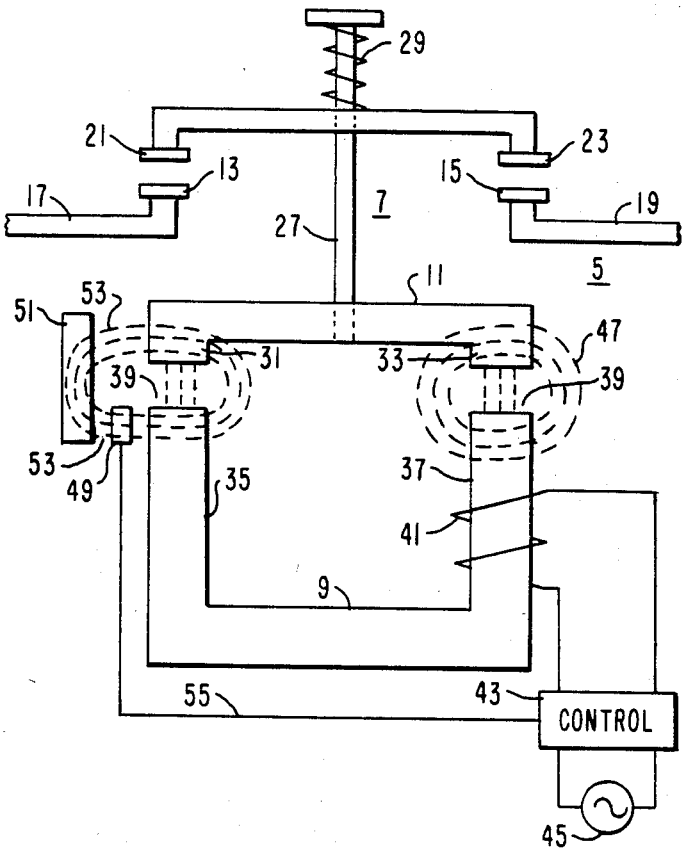
FIG. 1 is a schematic view of an electromagnetic device.

An electromagnetic device is generally indicated at 5 in FIG. 1 and it comprises contactor 7 and a magnetically operated device including a stator or a yoke 9 and an armature 11. The contactor 7 comprises a pair of spaced stationary contacts 13, 15 mounted on conductors 17, 19, respectively. The contactor also includes a pair of movable contacts 21, 23 mounted on a contact carrying arm 25 which is supported at the upper end of a rod 27. The upper end of the rod preferably includes a coil spring 29 for applying a variable pressure between the contacts 13–23 when the contacts are closed.

The armature 11 is fixedly mounted at the lower end of the rod 27 where it is suspended above the stator 9 and preferably includes a pair of down-turned end portions 31, 33 which are aligned with up-turned portions 35, 37 of the stator 9. In the unenergized condition of the stator, an armature 11 is spaced above the stator by suitable means such as a spring (not shown) thereby providing a gap 39 between corresponding end portions 31, 33 and up-turned portions 35, 37. In this position of the armature 11 the movable contacts 21, 23 are in the open position with respect to the stationary contacts 13, 15.

The stator 9 is energized by a coil 41 which is controlled by a control center 43 which is connected to a power source 45. Accordingly, when the stator 9 is energized by the coil 41, the armature 11, in response to a magnetic field indicated by field lines 47 in and around the gaps 39, is pulled magnetically to the stator portions 35, 37, closing the gaps 39. Manifestly, the contact carrying arm 25, in response to pressure on the spring 29 closes the circuit through the several contacts 13, 21 and 15, 23.

In accordance with this invention a magnetic sensing device 49 is provided for measuring any voltage existing in the magnetic field lines 7 in the interval of time between energizing the coil 41 and lowering of the armature 11. For that purpose shunt means, such as a soft iron bar 51, is provided near the gap 39 but not touching the stator or armature to enable magnetic field lines 53 to bypass the gap. The magnetic sensing device 49 is disposed in the space between the bar 51 and the stator for the purpose of monitoring or sensing the voltage in the field lines 53. When power is applied to the coil 41 and the armature and stator are open, the magnetic sensor device 49 senses the voltage in the magnetic field 53. When the gap 39 is closed, the sensor 49 sees no magnetic field because the field is almost completely confined to the iron of the stator 9 and armature 11. However the magnetic sensing device 49 can detect a gap of only 0.002 inch or less.

When the sensing device detects any voltage as a result of a magnetic field passing through the shunt bar 51, it transmits a signal through a cable 55 to the control center 43 which in turn increases power to the coil 41. The magnetic sensor or sensing device 49 monitors the voltage difference between the closed and opened positions of the stator-armature including the gap of only a few thousandths of an inch which may exist before the contacts are completely closed. If the armature 11 tends to pull away from the stator 9 because of a momentary power failure, mechanical disturbance or the like, this tendency is sensed and full power is applied to the pull-in coil 41 until the stator-armature is completely closed again.

Figure 2:
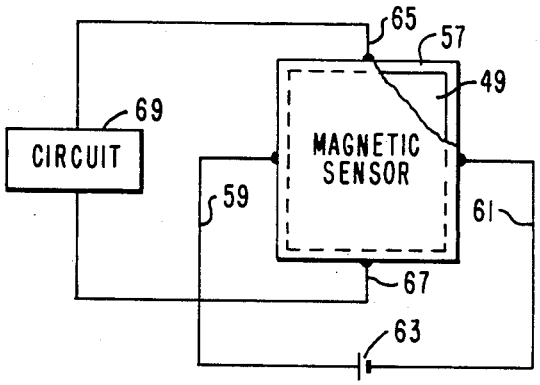
FIG. 2 is a schematic view of a magnetic sensor as used in FIG. 1.

The magnetic sensor or sensing device 49, being disposed between the shunt bar 51 and the armature 11, or stator 9 (as shown in FIG. 1) is preferably encased within an insulating cover 57 (FIG. 2). The magnetic sensing device 49 is comprised of a semiconductor, such as a Hall Effect Sensor. The cable 55 includes a pair of conductors 59, 61 for power leading from the power source 63 or from the control center 43. In addition, a cable 55 includes a pair of leads 65, 67 extending from opposite sides of the body of the semiconductor sensing device 49 for measuring of the voltage across the device in response to the intensity of the magnetic field lines 53. For that purpose the leads 65, 67 extend to a circuit 69 within the control center 43 and thereby directs the center to apply power to the coil 41 substantially in accordance with the voltage in the sensor 49. Manifestly, where the gap 39 is closed the magnetic field lines 47, 53 are practically eliminated and the power to the coil 41 is reduced substantially to a value necessary only to maintain the armature 11 in contact with the stator 9.

The magnetic sensing device 49 may be a Hall Element or Effect Sensor which is available through Pioneer Precision Machinery Corporation at 6-1-1 Fujimi, Tsurugashima-Machi, Iruma-gun, Saitama, Japan.

The control center is operable with either AC or DC current. Where an AC source is used it may be fed to both the coil 41 and the sensor 49. However, to avoid a noise due to AC, a DC source may be used or the control center 43 may convert an AC source to DC power for both coil 41 and the sensor 49.

In conclusion, the magnetic sensing device of this invention discloses a means for providing a higher power for closing the armature onto the stator with a subsequent reduction of power to the coil once the armature and stator are closed. The advantages derived from this include a conservation of power which in turn results in reducing vibration and heating which would otherwise result from operation of the coil at a higher energy level. Finally, because of the reduced energy necessary to maintain the closed contacts a reduction in size of the overall device is available.

What is claimed is:

1. A magnetic sensing device comprising:

a stator having an energizing coil for inducing a magnetic field;

an armature movable between open and closed positions of the stator and forming a gap between the armature and stator when in the open position;

shunt means spaced from the armature and stator for transferring a magnetic field therebetween;

a magnetic sensing device between the shunt means and one of the stator and armature for monitoring the magnetic field and for producing a resulting voltage; and control means responsive to the voltage produced by the device for controlling the power applied to the coil, so as to reduce power to the coil in response to a reduced magnetic field when the gap is closed.

2. The magnetic sensing device of claim 1 in which the magnetic sensing device comprises a semiconductor.

3. The magnetic sensing device of claim 1 in which the shunt means comprises a soft iron member.

4. The magnetic sensing device of claim 1 in which the magnetic sensing device is between the stator and the shunt means.

5. The magnetic sensing device of claim 2 in which the semiconductor is enclosed in an electrically insulating cover.

* * * * *